US010835941B2

(12) United States Patent
Wendt

(10) Patent No.: US 10,835,941 B2
(45) Date of Patent: Nov. 17, 2020

(54) DEVICE FOR ADJUSTING AN EDGING ROLL OF AN EDGING STAND

(71) Applicant: SMS Group GmbH, Duesseldorf (DE)

(72) Inventor: Stefan Wendt, Hilchenbach (DE)

(73) Assignee: SMS GROUP GMBH, Duesseldorf (DE)

( * ) Notice: Subject to any disclaimer, the term of this patent is extended or adjusted under 35 U.S.C. 154(b) by 302 days.

(21) Appl. No.: 15/772,838

(22) PCT Filed: Oct. 24, 2016

(86) PCT No.: PCT/EP2016/075482
§ 371 (c)(1),
(2) Date: May 2, 2018

(87) PCT Pub. No.: WO2017/076670
PCT Pub. Date: May 11, 2017

(65) Prior Publication Data

US 2018/0326466 A1 Nov. 15, 2018

(30) Foreign Application Priority Data

Nov. 5, 2015 (DE) ..... 10 2015 221 762

(51) Int. Cl.
*B21B 13/06* (2006.01)
*B21B 31/20* (2006.01)
*B21B 31/32* (2006.01)

(52) U.S. Cl.
CPC ..... *B21B 13/06* (2013.01); *B21B 31/203* (2013.01); *B21B 31/32* (2013.01)

(58) Field of Classification Search
CPC ..... B21B 1/224; B21B 13/06; B21B 37/22; B21B 2261/06; B21B 31/16; B21B 31/20; B21B 31/32; B21B 37/62; B21B 31/203
(Continued)

(56) References Cited

U.S. PATENT DOCUMENTS 4,152,918 A 5/1979 Tanaka
4,590,778 A 5/1986 Kloeckner
(Continued)

FOREIGN PATENT DOCUMENTS

CA 2542103 10/2004
CN 101767109 7/2010
(Continued)

*Primary Examiner* — Shelley M Self
*Assistant Examiner* — Fred C Hammers
(74) *Attorney, Agent, or Firm* — Abelman, Frayne & Schwab

(57) ABSTRACT

The invention relates to a device 1 for positioning an edging roll 10 of an edging stand, comprising an edging frame 12 to which at least one balancing cylinder 14 is attached, a balancing crossbeam 16 with a drive side 18 positioned opposite of the edging frame 12, and a working side 19 positioned opposite of the drive side 18, wherein a bearing device 20 for the edging roll 10 can be attached, in particular in an interlocking manner, to the balancing crossbeam 16 on the working side 19 thereof and at least one linkage 24 is provided on the drive side 18 thereof, by which linkage the balancing cylinder 14 is in an operative connection with the balancing crossbeam 16, and at least one positioning cylinder 26 attached to the edging frame 12 can be brought into an operative connection with the bearing device (20) in the direction of a rolled material in order to position the edging roll 10 against the rolled material, wherein the compressive force generated by the positioning cylinder 26 acts on the bearing device 20 along an operational axis 28, which either intersects with the at least one linkage 24 by which the balancing cylinder 14 is operatively connected with the balancing crossbeam 16 or runs directly alongside this linkage 24.

15 Claims, 4 Drawing Sheets

Figure 1:
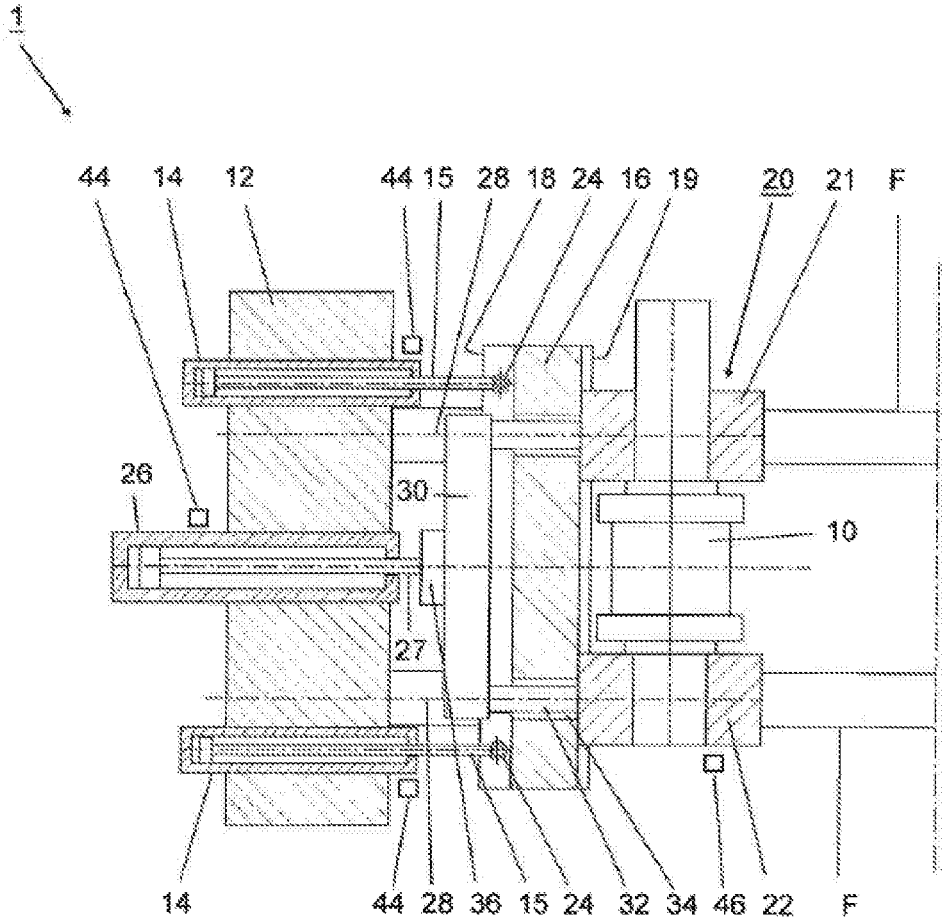

(58) Field of Classification Search
USPC ..... 72/225, 245
See application file for complete search history.

(56) References Cited

U.S. PATENT DOCUMENTS

| | | | | |
|---|---|---|---|---|
| 8,276,423 | B2 | 10/2012 | Habermann | |
| 8,573,016 | B2 | 11/2013 | Wendt | |
| 8,627,699 | B2 * | 1/2014 | Eckelsbach | B21B 13/06<br>72/252.5 |
| 9,016,100 | B2 | 4/2015 | Clark | |

FOREIGN PATENT DOCUMENTS

| | | | | |
|---|---|---|---|---|
| CN | 104399744 | | 3/2015 | |
| DE | 102005025711 | | 12/2006 | |
| GB | 750996 | | 6/1956 | |
| JP | 52 109467 | * | 3/1976 | B21B 13/06 |
| JP | 52109467 | | 9/1977 | |
| JP | 5689311 | | 7/1981 | |
| JP | 60129407 | | 7/1985 | |
| JP | 6156701 | | 3/1986 | |
| JP | 63111206 | | 7/1988 | |
| JP | 2012218060 | | 11/2012 | |
| WO | 9104107 | | 4/1991 | |

* cited by examiner

DEVICE FOR ADJUSTING AN EDGING ROLL OF AN EDGING STAND

RELATED APPLICATIONS

This application is a National Stage application of International application PCT/EP2016/075482 filed Oct. 24, 2016 and claiming priority of German application DE 102015221762.0 filed Nov. 5, 2015, both applications are incorporated herein by reference thereto.

The invention relates to a device for positioning an edging roll of an edging stand.

From prior art, edging stands are known, with which, for instance during the rolling of heavy plate, an edging roll may be positioned against the side of the rolled material, or laterally pressed against the rolled material. Such edging stands are known, for instance, from EP 2 265 395 B1, EP 2 411 165 B1, or JP 01075101 A, which feature one or two positionings on each side. For the mounting of the edging roll, these edging stands comprise a massive cassette, which takes up a large assembly space, and which still allows for play for the roll and the positioning during rolling operations.

An edging stand for positioning an edging roll is known from EP 166 981 B1, in which a reduction of the play between the components of the edging stand is accomplished by having a piston cylinder assembly press a cassette, in which the edging roll is incorporated on bearings, in the direction of the rolled material, such that so-called balancing cylinders pull the cassette in the opposite direction. This practically eliminates the play in the joints between the components of this edging stand, such that an increased precision for positioning the edging roll against the rolled material ensues.

The edging stand according to EP 166 981 B1 suffers from the disadvantage that a piston of the piston cylinder assembly pressing the cassette and the incorporated edging roll in the direction of the rolled material is at a distance from the articulated balancing cylinders. In the event that the forces, which are generated by both the piston cylinder assembly and the balancing cylinders are not exactly balanced, a disadvantage results in that the cassette is not exactly translatorily guided, from which follows an imprecise positioning of the edging roll.

Accordingly, the object of the invention is to create a device for positioning an edging roll of an edging stand in which a precise translatory guidance of the edging roll without the risk of tilting or the like is guaranteed by simple means.

This problem is solved by providing a device with the characteristics of claim 1. Advantageous further developments of the invention are defined in the dependent claims.

A device according to the present invention serves for positioning an edging roll of an edging stand, and comprises an edging stand, to which at least one balancing cylinder is attached, and a balancing crossbeam with a drive side positioned opposite of the edging stand, and a working side positioned opposite of the drive side, wherein a bearing device for the edging roll can be attached to the balancing crossbeam on the working side thereof, and at least one linkage is provided on the drive side thereof, by which linkage the balancing cylinder is in an operative connection with the balancing crossbeam. The device further comprises at least one positioning cylinder attached to the edging stand, which can be brought into an operative connection with the bearing device in the direction of a rolled material in order to position the edging roll against the rolled material, wherein the compressive force generated by the positioning cylinder acts on the bearing device along an operational axis, which either intersects with the at least one linkage by which the balancing cylinder is operatively connected with the balancing crossbeam, or runs directly alongside this linkage.

Underlying the invention is the material understanding that an edging roll can be pressed against a rolled material as in case of an actuation of the at least one positioning cylinder, such that the bearing device, in which the edging roll is incorporated on bearings, is pulled by means of the at least one balancing cylinder in the opposite direction in order to thus obtain freedom of movement in the joints between components of the device. By having the operational axis, along which the compressive force generated by the positioning cylinder acts on the bearing device, intersect with the at least one linkage or run immediately alongside this linkage, an absence of tilting moment applied the bearing device and on to the edging roll incorporated on it on bearingsis ensured, and therefore, a high-precision linear movement of the edging roll, specifically in the direction of the rolled material, is always given.

In an advantageous further development of the invention, two balancing cylinders may be attached to the edging stand, such that the positioning cylinder is arranged between the balancing cylinders. Actuators of the respective balancing cylinders are arranged on the drive side of the balancing crossbeam, in such a way that a supplementary component is arranged between the edging stand and the balancing crossbeam by which an actuator of the positioning cylinder can be brought into an operative connection. Opposite of the drive side of the balancing crossbeam, the supplementary component features two elongated pressure pins, the longitudinal axis of which defines the operational axis, along which the compressive force is applied to the bearing device. The pressure pins reach across the balancing crossbeam, such that the compressive force of the positioning cylinder is branched out to the two pressure pins and can be transmitted onto the bearing device for the edging roll on the working side of the balancing crossbeam. For these purposes, the free front faces on the working side of the balancing crossbeam may come into contact with the bearing device.

With respect to a pressure pin through which a compressive force is applied to the bearing device or the respective edging roll, it must be understood that such a pressure pin may have a suitable cross section, for instance circular, square, rectangular, triangular or polygonal. For instance, in case of a circular cross section, a pressure pin is embodied in the form of a cylinder. In any event, the cross section of the pressure pin is selected such that on the one hand, sufficient stability against breaking is guaranteed, and on the other hand, guiding the pressure pin over slide bearings is possible, if necessary.

It bears pointing out that the free front faces of the pressure pins are not attached to the bearing device for the edging roll, but rather, that they may merely come into contact with the bearing device, given the respective actuation of the positioning cylinder, in order to apply a compressive force to the bearing device in the direction of a rolled material. The resetting of the balancing crossbeam, in other words, moving it in a direction away from the rolled material, is achieved through the actuation of the at least one balancing cylinder, the of which is provided on the drive side of the balancing crossbeam.

In an advantageous further development of the invention, the point of contact between the actuator of the positioning cylinder and the supplementary component may be embodied in a convex manner. For instance, this point of contact may be embodied such that a point contact or surface contact is formed. This guarantees a precise transmission of power between the positioning cylinder and the supplementary component—in the direction of the rolled material—without a risk of tilting or similar effects.

In an advantageous further development of the invention, the actuator of the positioning cylinder may be connected by a cylinder head with the supplementary component, such that transverse forces that may operate on the pressure pins and/or on the supplementary component in the direction transverse to the operational axis, in particular at the time of the piercing thrust, are transmitted to the positioning cylinder in a reduced manner, or not transmitted at all. By such a design of the positioning cylinder with a cylinder head, damage to expensive positioning cylinder may be advantageously prevented, in particular at the time of the piercing thrust. In this respect, it bears pointing out that it is not necessary for the cylinder head to be cylindrically executed, but rather, that it essentially have the property of keeping any transverse forces acting transverse to the operational axis of the positioning cylinder away from the positioning cylinder.

In an advantageous further development of the invention, the actuator of the positioning cylinder may be connected by an articulate joint with the supplementary component. This articulated joint connection guarantees that the compressive force generated by the positioning cylinder acting on the pressure pins attached to the supplementary component always only acts along the operational axis, even when the actuator of the positioning cylinder isnot aligned exactly parallel to the operational axis.

According to an alternative embodiment of the device according to the invention, two positioning cylinders may be attached to the edging stand, such that a balancing cylinder is arranged between the positioning cylinders. The positioning cylinders are connected with elongated pressure pins, the longitudinal axis of which defines the operational axis, along which the compressive force is applied to the bearing device for the edging roll. The pressure pins reach across the balancing crossbeams, such that the compressive force of the respective positioning cylinders at the working side of the balancing crossbeam can be transmitted onto the bearing device for the edging roll. A supplementary component is arranged between the edging stand and the balancing crossbeam with which an actuator of the balancing cylinders is connected, such that the supplementary component is connected with the drive side of the balancing crossbeam by two linkages.

The last mentioned embodiment of the invention has the advantage that the resetting force generated by the balancing cylinder is branched out via the supplementary component and transmitted to the balancing crossbeam. As the linkages by which the supplementary component is connected with the drive side of the balancing crossbeam are either made to intersect with the operational axis or to run immediately alongside the operational axis, it is guaranteed that due to the interplay between the tensile and compressive forces acting on the bearing device, at best, no tilting moment is generated at all, so that tilting and similar movements are prevented.

With respect to the balancing cylinder and the positioning cylinder, it bears pointing out that these components of the present invention do not necessarily have to be embodied in a cylindrical form, but rather, they should be understood as an actuation element by which a suitable compressive or tensile force can be generated. Taking this into account, the balancing cylinders, or respectively, the positioning cylinders may be hydraulically or electrically driven. With respect to the positioning cylinder, it bears pointing out separately that for simplification purposes, merely an actuation in a single direction may be provided, specifically in the direction of a rolled material, in order to press the edging roll against the rolled material. An actuation of the positioning cylinder in the opposite direction is not required, since when the balancing cylinder applies a tensile force, and there is a respective traversing movement of the balancing crossbeam, the positioning cylinder is automatically reset due to the contact between the bearing device and the free front faces of the pressure pin.

In an advantageous further development of the invention, a contact surface for the edging roll may be formed on the bearing device, by which the front faces of a pressure pin may be brought into a contact position through an actuation of the associated positioning cylinder. Preferentially, this contact surface may be appropriately hardened, such that premature wear and tear of this contact surface as a result of the frequent contact with the front faces of the pressure pin is avoided.

In an advantageous further development of the invention, the point of contact between the front faces of a pressure pin and the contact surface of the bearing device may be embodied in a convex manner, such that at this point of contact, a point contact or a surface contact are formed. This prevents a possible tilting between the front faces of the pressure pin and the bearing device, and a precise linear guidance of the bearing device, and therefore of the edging roll in the direction of a rolled material is guaranteed when the pressure pin presses against the bearing device. The convex embodiment of said point of contact may be realized by means of the convex embodiment of the front faces of a pressure pin and/or the associated contact surface at the bearing device, respectively.

With respect to the point of contact, it bears pointing out for all the aforementioned embodiments of the invention that each of the surfaces of the objects brought into contact with each other may be embodied in a convex manner. In the alternative, it is also possible that of the objects brought into contact with each other at the point of contact one object features a convex surface, whereas the respective other object features a concave surface.

The present invention distinguishes itself by a "sleek" and modular construction. The interaction between the mechanical components guarantees that the device according to the invention is fully balanced, eliminating any play in the joints, or elsewhere.

The device according to the present invention may be used in all known edging stand types, independently of the drive system (above or underneath the steel mill floor). This allows for a wider application field for edging stands, for instance by including applications when space is limited. Finally, in the device according to the invention, the maintenance and/or a replacement of its components have been substantially simplified.

It is a further advantage for the invention when at least one position sensor is provided for receiving information about the current position of the edging roll. For these purposes, the position sensor maintains a signal connection with an evaluation device, by means of which the current position the edging roll can be determined.

In an advantageous further development of the invention, a control device may be provided, maintaining a signal connection with the evaluation device. Accordingly, a measurement signal from the position sensor can be processed in the control device. By means of the control device, the balancing cylinder and/or the positioning cylinder can be driven as a function of a measurement signal from the position sensor. The control of the balancing cylinder and/or the positioning cylinder can further be regulated, since the control device for the balancing cylinder and the positioning cylinder are provided with a regulation circuit for these purposes.

In an advantageous further development of the invention, the respective current positions of the actuator actuation media of the balancing cylinder and the actuator of the positioning cylinder can be monitored by position sensors. For these purposes, such position sensors are arranged adjacent to the balancing cylinder and the positioning cylinder. Since these position sensors are in a signal connection with the evaluation device, a respective current position of an actuator of the balancing cylinder or of the positioning cylinder can be determined by the evaluation device. In this context, it is a further advantage when the control of the balancing cylinder and/or of the positioning cylinder is performed as a function of a previously determined position of their actuator(s), possibly taking into account respective target positions. Furthermore, the control of the balancing cylinder and/or of the positioning cylinder can also be regulated, specifically by the control device, which comprises a regulation circuit for this purpose.

Hereinafter, exemplary embodiments of the invention are described in detail, based on a schematically simplified drawing.

Figure 2:
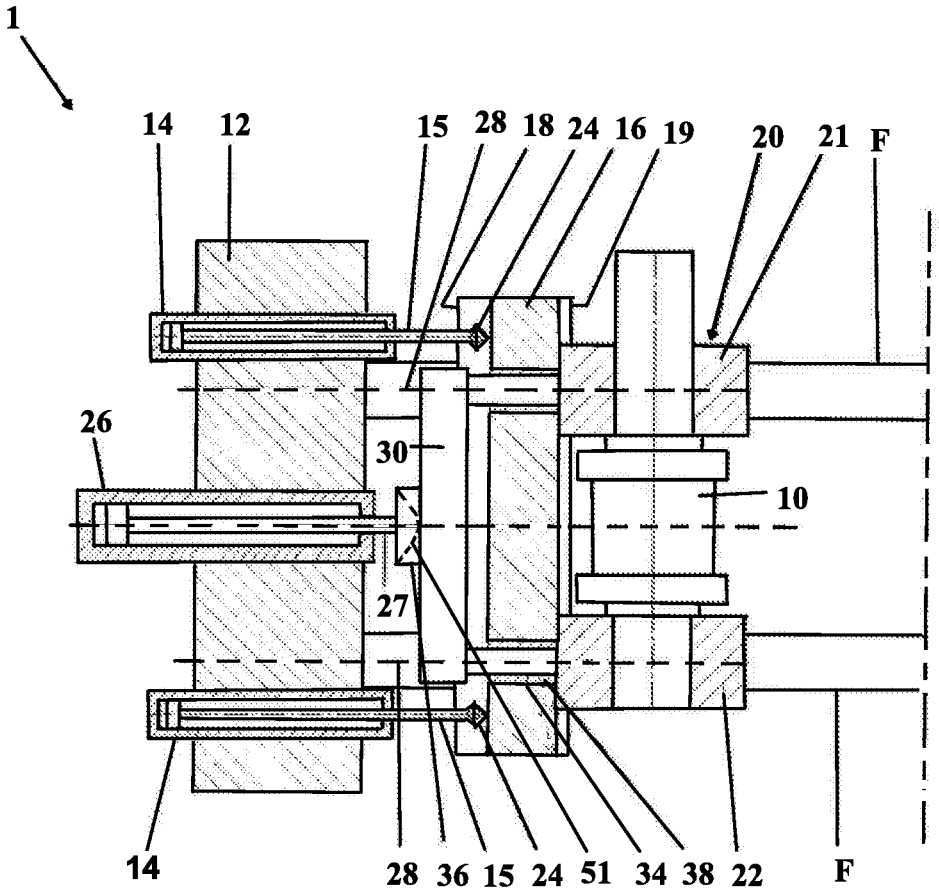
Figure 3:
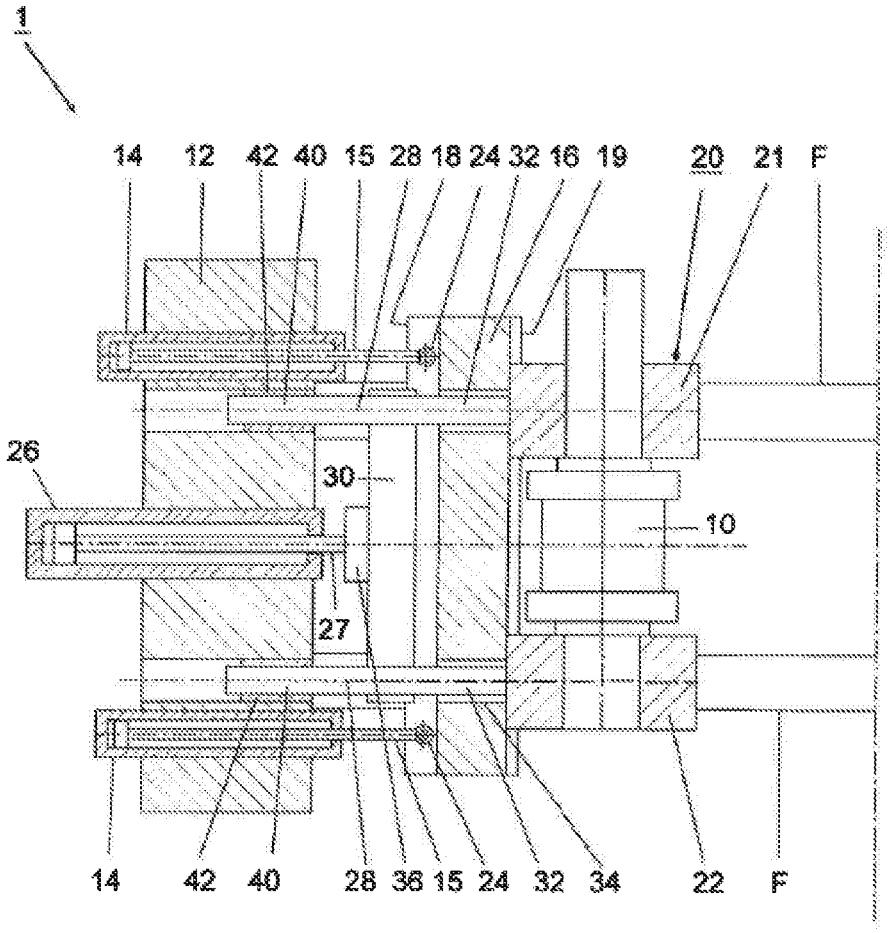
Figure 4:
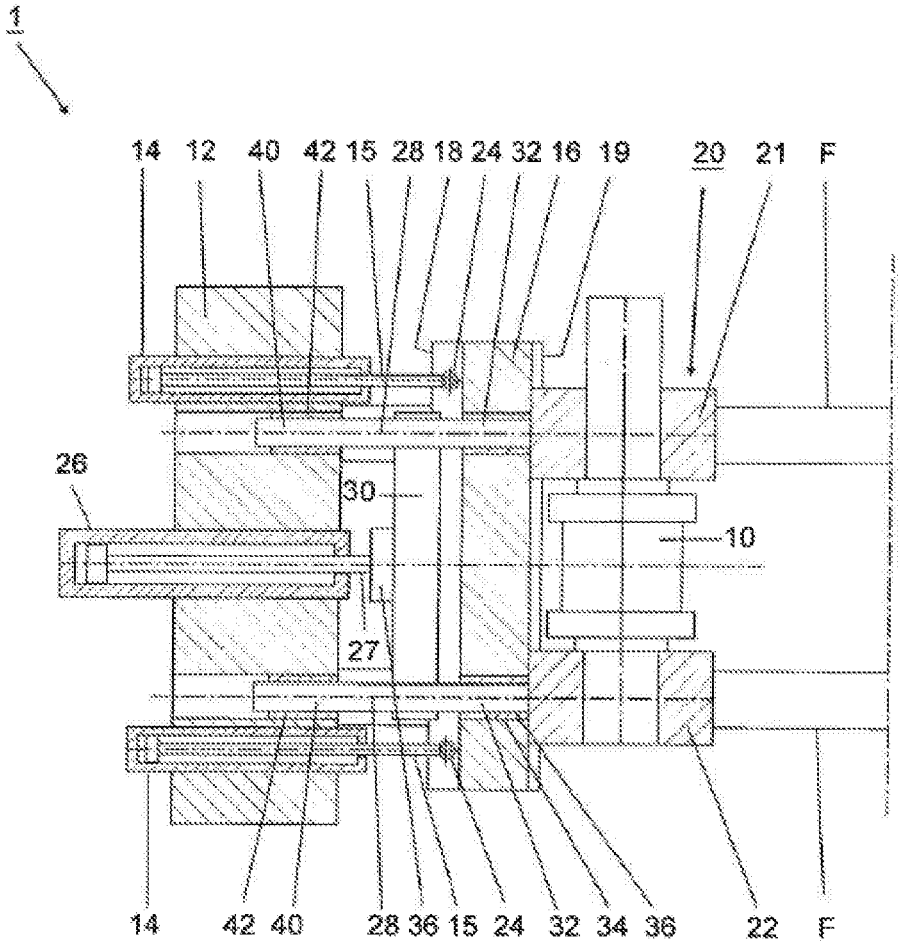

The drawings show:

FIG. 1 a simplified lateral cross-sectional view of a device according to the invention;

FIG. 2 a simplified lateral cross-sectional view of a device according to the invention according to a different embodiment;

FIG. 3 a simplified lateral cross-sectional view of a device according to the invention according to another different embodiment, and FIG. 4 a simplified lateral cross-sectional view of a device according to the invention according to yet another embodiment.

In FIGS. 1 through 4, respectively different embodiments of a device 1 according to the present invention are shown. For identical parts, respectively identical reference numbers are used.

FIG. 1 shows a simplified lateral cross-sectional view of the device 1, comprising an edging roll 10 and an edging frame 12, in which two balancing cylinders 14 are arranged. Between the edging roll 10 and the edging frame 12, a balancing crossbeam 16 is arranged, having a drive side 18 and a working side 19. On the working side 19 of the balancing crossbeam 16, a bearing device 20 is attached, preferentially in an interlocking manner, such that the bearing device 20 comprises an upper edging roll chock 21 and a lower edging roll chock 22. The edging roll 10 is incorporated on bearings between these edging roll chocks 21, 22. A translatorily and preferentially horizontal shift of the edging roll 10 is guaranteed by the fact that the edging roll chocks 21, 22 are respectively arranged or mounted on bearings on guide rails F in a slidable manner.

The balancing cylinders 14 respectively comprise actuator 15, which are connected by a linkage 24 with the drive side 18 of the balancing crossbeam 16.

In the edging frame 12, between the two balancing cylinders 14, a positioning cylinder 26 is arranged, the actuator 27 of which interacts with a supplementary component 30. The supplementary component 30 features two pressure pins 32 extending from of the drive side 18 to the working side 19 of the balancing crossbeam 16, and more specifically extend through passage holes 34 embodied in the balancing crossbeam 16 in the direction of the bearing device 20 or of the edging roll chocks 21, 22.

A free front end of the actuator 27 of the positioning cylinder 26 may be connected with the supplementary component 30 by a cylinder head 36. In the alternative, it is also possible that the free front end of the actuator 27 be connected with the supplementary component 30 by an articulated joint connection. The cylinder head 36 is illustratively round or rectangular having a flat planar free end that is brought into contact with the supplementary component as shown in FIG. 1. The point of contact therebetween can be embodied as a surface contact (FIG. 1) or a point contact, as illustratively shown in FIG. 2. Referring to FIG. 2, a person of ordinary skill in the art will appreciate that a point of contact between the actuator (27) of the positioning cylinder (26) and the supplementary component (30) can be embodied with a convex shape as shown in phantom by the broken lines 51 at the free end of the cylinder head 36. Alternatively, the point of contact can be embodied either by respective convex surfaces or by one convex surface and one concave surface. Similarly, a person of ordinary skill in the art will appreciate that the point of contact between the front face of the pressure pins (32) and the contact surface of the bearing device (20) can be embodied with a convex shape, such that a point contact is formed on the point of contact.

At this point, it bears pointing out that FIG. 1 only shows a half section of a device according to the invention, as demonstrated by the vertical symmetry line on the right border of the image.

The invention functions as follows:

Upon the actuation of the positioning cylinder 26, its actuator 27 is moved outward, which in the drawing plane of FIG. 1 is from left to right. As a result, the supplementary component 30, and in combination with it also the two pressure pins 32, are moved into the same direction, such that the free front faces of the pressure pins 32 are brought into contact with the edging roll chocks 21, 22. With their longitudinal axis, the pressure pins 32 respectively define an operational axis 28, along which the compressive force generated by the positioning cylinder 26 is transmitted to the bearing device 20, and therefore to the edging roll 10 incorporated on it on bearings. While, as previously explained, the positioning cylinder 26 exerts a compressive force in the direction of the bearing device 20, a tensile force is exerted by the balancing cylinder 14 on the balancing crossbeam 16. Through the counteractive or counter-directional forces, i.e., interplay as between the compressive force generated by the positioning cylinder 26 and the tensile force generated by the balancing cylinders 14, the joints of the device 1 are advantageously freed of play, resulting in a high-precision translatory shift of the edging roll 10 in the direction a (not illustrated) rolled material. For the positioning of the edging roll 10 against the rolled material, it should be understood that the compressive force generated by the positioning cylinder 26 is larger than the tensile force generated by the balancing cylinder 14.

The representation in FIG. 1 demonstrates that the operational axis 28, along which the compressive force is applied to the bearing device 20, extends in a direction from the actuators 15 of the respective balancing cylinders 14 that are connected with the drive side 18 (via the linages 24) towards the working side 19 of the balancing crossbeam 16. Therefore, even in the event that the forces of the balancing cylinders 14 on the one hand and of the positioning cylinder 26 on the other hand do not cancel each other out or exist in equilibrium, there will not be a tilting moment on the balancing crossbeam 16 and on the bearing device 20 attached to it, such that a precise positioning of the edging roll 10 is still ensured.

It bears pointing out once more that a positioning of the edging roll 10 against a (not illustrated) rolled material is achieved exclusively by an actuation of the positioning cylinder 26, such that the pressure pins 32 extending through the passage holes 34 in the balancing crossbeam 16 in the direction of the bearing device 20 press against the edging roll chocks 21, 22. At the same time, a tensile force is exerted via the balancing cylinders 14, which acts on the balancing crossbeam 16 via the linkage 24 in order to ultimately realize a play between the components of the device 1. According to a simplified embodiment, the positioning cylinder 26 may be embodied such that its actuator 27 only exerts a force in one direction, specifically from left to right in the drawing plane of FIG. 1. A resetting of the positioning cylinder 26 in the opposite direction, in other words, from right to left in the drawing plane of FIG. 1, may then occur automatically when the positioning cylinder 26 is without power, while a tensile force continues to be exerted on the balancing crossbeam 16 by the balancing cylinders 14.

FIG. 2 shows an additional embodiment of the device according to the invention 1. In a further development of the embodiment of FIG. 1, the passage holes 34 feature slide bearings 38 in order to translatorily guide the pressure pins 32 in their horizontal shift. In all other respects, the other parts of the embodiment of FIG. 2 correspond to those of FIG. 1. We refer to the explanation of FIG. 1 in order to avoid repetitions.

FIG. 3 shows a simplified lateral cross-sectional view of an additional embodiment of the device 1 in which the supplementary component 30 positioned opposite of the edging frame 12 features two guide pins 40, respectively guided longitudinally in slide bearings 42 provided in the edging frame 12. Expediently, the guide pins 40 and the pressure pins 32 may be embodied in one piece, such that one end of a single pin or rod is configured as the guide pin 40 for guiding the supplementary component 30, while the opposing end of the single pin or rod is configured as the pressure pin 32 for applying a force onto the bearing 20.

FIG. 4 shows a simplified lateral cross-sectional view of an additional embodiment of the device according to the invention 1, constituting a combination of the embodiments of FIGS. 2 and 3. This means that in the embodiment according to FIG. 4, both the pressure pins 32 and the guide pins 40 are guided longitudinally in slide bearings 34 or 42, respectively, these slide bearings being provided in the balancing crossbeam 16 and in the edging frame 12, respectively. The slide bearings 34 and 42 may be embodied as guide bushings. In the alternative, it is also possible for such slide bearings to be embodied as flat tracks or in the form of a spherical embodiment. In any event, the slide bearings are adjusted to a respective cross-sectional shape of a pressure or guide pin 32, 40.

Identically to the pressure pins 32, the guide pins 40 may be suitably embodied in their cross section as well. They may, for instance, be circular, square, rectangular, triangular, or polygonal. In particular in the event that the guide pins 40 and the pressure pins 32 are embodied in one piece, it is expedient that their cross-sectional shape be identical.

With respect to the embodiments according to the FIGS. 2 through 4, it bears pointing out that the guidance of the pressure pins 32 or the guide pins 40 in the associated respective slide bearings improve the precision of a translatorily shift of the supplementary component 30 even further, and that as result, the positioning of the edging roll 10 against a rolled material is optimized.

With respect to all embodiments of the device 1 according to the present invention, it bears pointing out that the balancing cylinder 14 can be embodied such that in comparison to the positioning cylinder 26, they may feature a much longer movement path in the direction of the middle of a rolling line. By a respective actuation of the balancing cylinders 14, it is therefore possible to move the bearing device 20, and therefore also the edging roll 10, until the middle of a rolling line, for instance for maintenance the purposes or in order to replace the edging roll 10. In case of such a long movement of the bearing device 20 towards the middle of a rolling line, the positioning cylinder 26 is not actuated, such that the pressure pins 32 are not moved either, because their front faces are not attached to the edging roll chocks 21, 22.

For the balancing cylinder 14 and the positioning cylinder 26, respective position sensors 44 may be provided, by means of which a respective current position of the actuator 15 of the respective balancing cylinders 14 or of the actuator 27 of the positioning cylinder can be specified, and similarly, a conclusion about the current position of the bearing device 20 and the edging roll 10 mounted on it is possible. For these purposes, the position sensors 44 are in a signal connection with an evaluation device (not shown).

It is further possible to provide a position sensor 46 adjacent to the bearing device 20 for the edging roll, such that this position sensor 46 is also in a signal connection with an evaluation device (not shown). Accordingly, a current position in the rolling station of the bearing device 20 and of the edging roll 10 mounted on it can be determined by means of this position sensor 46 and the evaluation device with which it is connected.

For the purpose of simplification, the position sensors 44, 46 are shown in a symbolic greatly simplified manner only for the embodiment of FIG. 1 and may be similarly provided for the embodiments of FIGS. 2 through 4 as well.

If position sensors 44 are provided for the balancing cylinder 14 and the positioning cylinder 26, and a position sensor 46 is provided for the bearing device 20 as well, these position sensors 44, 46 may be in a signal connection with a joint evaluation device.

An actuation of the balancing cylinders 14 and of the positioning cylinder 26 may be done by a control device (not shown). For these purposes, the control device may be in a signal connection with the evaluation device, such that control of the balancing cylinders 14 and/or of the positioning cylinder 26 is accomplished as a function of a measurement signal from at least one position sensor. This means that the balancing cylinder 14 and/or the positioning cylinder 26 are controlled as a function of the respective current position of their actuator(s) 15, 27 or respectively of the current position of the edging roll 10 in the rolling station, if applicable taking into account associated target positions. The actuation of the balancing cylinders 14 and of the positioning cylinder 26 by the control device can expediently be done in a regulated form, for which purpose the control device is equipped with a respective regulation circuit. In conclusion, it bears pointing out that the evaluation device and the control device may also be integrated into a joint control unit.

REFERENCE LIST

1 Reference list
10 edging roll

12 edging stand
14 balancing cylinder
16 balancing crossbeam
18 drive side
19 working side
20 bearing device
24 linkage
26 positioning cylinder
27 actuator
28 slide bearings
30 supplementary component
32 pressure pin
40 guide pin
44 position sensor
46 position sensor

The invention claimed is:

1. A device for positioning an edging roll (10) of an edging stand, comprising:

an edging stand, to which at least one balancing cylinder is attached;

a balancing crossbeam with a drive side positioned opposite the edging stand and a working side positioned opposite the drive side, wherein a bearing device for the edging roll is selectively attached to the working side of the balancing crossbeam, and at least one linkage is provided on the drive side of said balancing crossbeam, by which the at least one balancing cylinder is in an operative connection with the balancing crossbeam, and a positioning cylinder arranged on the edging stand, which can be brought into an operative connection with the bearing device in a direction of a rolled material in order to position the edging roll against the rolled material, wherein a compressive force generated by the positioning cylinder acts on the bearing device along an operational axis, which either intersects with the at least one linkage by which the at least one balancing cylinder is operatively connected with the balancing crossbeam, or a line of action of the compressive force is directed to the working side adjacent to the at least one linkage so that no tilting moment is applied to the bearing device and the edging roll supported therein;

wherein the at least one balancing cylinder includes two balancing cylinders with the positioning cylinder arranged therebetween on the edging stand; wherein an actuator of each of the balancing cylinders is articulated on the drive side of the balancing crossbeam; wherein between the edging stand and the balancing crossbeam, a supplementary component is arranged so that an actuator of the positioning cylinder is selectively brought into an operative connection with the supplementary component; wherein the supplementary component is positioned opposite of the drive side of the balancing crossbeam and includes two elongated pressure pins, whose longitudinal axes defines an operational axis, and which are selectively extendable across the balancing crossbeam, wherein upon extension and translation of the actuator of the positioning cylinder, the compressive force of the positioning cylinder is branched out to the two pressure pins and is transmitted onto the bearing device for the edging roll on the working side of the balancing crossbeam.

2. The device according to claim 1, wherein a point of contact between at least one of the actuator of the positioning cylinder and the supplementary component has a convex shape.

3. The device according to claim 2, wherein the point of contact is embodied as a point contact or as a surface contact.

4. The device according to claim 2, wherein the point of contact is defined by respective convex surfaces or by one convex surface and one concave surface.

5. The device according to claim 1, wherein the actuator of the positioning cylinder is connected with the supplementary component by a cylinder head, such that transverse forces operating on the pressure pins and/or on the supplementary component in the direction transverse to the operational axis are transmitted to the positioning cylinder.

6. The device according to claim 1, wherein the actuator of the positioning cylinder is connected with the supplementary component by an articulate joint.

7. The device according to claim 1, wherein the bearing device for the edging roll consists of an upper edging roll chock and a lower edging roll chock, such that the edging roll is incorporated on bearings between the edging roll chocks.

8. The device according to claim 1, wherein the pressure pins extend through the balancing crossbeam and are longitudinally guided in slide bearings within the balancing crossbeam.

9. The device according to claim 1, wherein a contact surface is formed on the bearing device for the edging roll, by which the front face of each pressure pin is brought into a contact position in case of an actuation of the positioning cylinder.

10. The device according to claim 9, wherein the point of contact between at least one of the front face of each pressure pin and a corresponding contact surface of the bearing device has a convex shape, such that a point contact is formed on the point of contact.

11. The device according to claim 1, wherein a movement path of the balancing cylinders in the direction of the rolled material is longer than a movement path of the positioning cylinder, such that the edging roll can only be moved into the middle of a rolling line on which the device is positioned through the actuation of the balancing cylinders.

12. The device according to claim 1, wherein the positioning cylinder is operated in one direction towards the rolled material.

13. The device according to claim 1 wherein the balancing cylinders are operated bi-directionally, such that the balancing crossbeam and therefore the bearing device for the edging roll can be moved back and forth by the balancing cylinders.

14. The device according to claim 1, wherein at least one position sensor is provided, such that the at least one position sensor is in a signal connection with an evaluation device, such that a current position of the edging roll can be determined.

15. The device according to claim 14, wherein the evaluation device is in a signal connection with a control device for the balancing cylinders and for the positioning cylinder, such that the balancing cylinders and/or the positioning cylinder can be controlled as a function of a measurement signal from the at least one position sensor (44, 46), and the control of the balancing cylinders and/or of the positioning cylinder can be regulated.

* * * * *